US007134835B2

(12) United States Patent
Gotta et al.

(10) Patent No.: US 7,134,835 B2
(45) Date of Patent: Nov. 14, 2006

(54) PROCESS FOR MANUFACTURING A STATOR FOR VACUUM PUMP AND STATOR OBTAINED THEREBY

(75) Inventors: Romina Silvia Gotta, Bosconero (IT); Cinzia Del Missier, Turin (IT); Cristian Maccarrone, Turin (IT); Fausto Casaro, Turin (IT)

(73) Assignee: Varian S.p.A., Leini Torino (IT)

( * ) Notice: Subject to any disclaimer, the term of this patent is extended or adjusted under 35 U.S.C. 154(b) by 232 days.

(21) Appl. No.: 10/857,227

(22) Filed: May 28, 2004

(65) Prior Publication Data

US 2004/0247428 A1 Dec. 9, 2004

(30) Foreign Application Priority Data

Jun. 5, 2003 (IT) ..... TO2003A0420

(51) Int. Cl.
*F01D 1/36* (2006.01)

(52) U.S. Cl. ..... 415/90; 415/221

(58) Field of Classification Search ..... 29/888.02, 29/888.025; 415/90, 211.2, 221
See application file for complete search history.

(56) References Cited

U.S. PATENT DOCUMENTS 1,492,486 A 4/1924 Smith
2,730,297 A * 1/1956 Verhoeff et al. ..... 415/72
6,193,461 B1 * 2/2001 Hablanian ..... 415/90
6,454,525 B1 9/2002 Blecker et al.

FOREIGN PATENT DOCUMENTS

| | | | |
|---|---|---|---|
| DE | 2218615 | * | 10/1973 |
| DE | 2218615 | A | 10/1973 |
| EP | 0260733 | A1 | 3/1991 |
| EP | 0260733 | B1 | 3/1991 |
| EP | 1249612 | A1 | 10/2002 |

* cited by examiner

*Primary Examiner*—Edward K. Look
*Assistant Examiner*—Devin Hanan
(74) *Attorney, Agent, or Firm*—Bella Fishman

(57) ABSTRACT

A process for manufacturing stators of vacuum pumps, and stators obtained thereby, wherein a plurality of stator discs or rings are formed, preferably by pressing, and then stator discs or rings are coaxially stacked and mutually rotated so as to form a stator surface having defined thereon at least one groove extending in substantially axial direction with respect to a body of the stator.

16 Claims, 4 Drawing Sheets

PROCESS FOR MANUFACTURING A STATOR FOR VACUUM PUMP AND STATOR OBTAINED THEREBY

FIELD OF THE DISCLOSURE

The present invention relates to a process for manufacturing vacuum pump stators and to stators obtained thereby.

BACKGROUND OF THE DISCLSOURE

Conventional pumping stages known in the vacuum field are obtained through the co-operation between a rotating cylindrical or frusto-conical rotor surface and a stationary, similarly cylindrical or frusto-conical stator surface, one or more axially extending grooves, e.g. helical grooves, being formed on one of the facing surfaces of the rotor or the stator.

Pumping stages of this structure is known in the art as Holweck stages. Pumping stages are widely employed in particular for low vacuum ranges in the so-called "backing pumps", downstream high-vacuum pumping stages, for instance turbo-molecular pumping stages. An example of such a vacuum pump is disclosed in the U.S. Pat. No. 1,492,486.

By alternating a plurality of coaxial cylindrical or frusto-conical rotors and stators, and by forming one ore more helical grooves on each wall of a pair of facing walls of the rotors or the stators, a plurality of Holweck pumping stages arranged in series or in parallel can be obtained, as shown, for example, in patents EP 260,733 and U.S. Pat. No. 2,730,297.

According to the prior art, the helical grooves are generally obtained by means of a mechanical working of a metal cylinder, for instance by milling.

The grooves may have variously shaped (e.g. rectangular, trapezoidal, etc.) profiles, may have variable sizes or, may have variable helix pitches. In view of different requirements for shape and sizes, forming these grooves by milling is very difficult and expensive.

It is the main object of the present invention to overcome the above drawback. A process is provided that allows for obtaining stators for pumping stages with substantially axially extending grooves, in quick and inexpensive manner.

It is another object of the invention to provide a process for easily manufacturing stators for pumping stages with axially extending grooves, for instance helical grooves of Holweck type with different characteristics.

It is a further object of the invention to provide with improved assembly and maintenance procedures.

SUMMARY OF THE DISCLOSURE

The process of the present invention allows for manufacturing stators of the vacuum pump in a simple, low cost way with certain versatility in obtaining the product.

According to the present invention a process for manufacturing stators comprising the step of forming a plurality of discs or rings and stacking up the rings for forming at least one stator surface with at least one groove, which extends in a substantially axial direction with respect to a body of the stator. Each disk or ring has at least one notch. When the disks or rings are stacked up the plurality of notches defines at least one grove. The helical grooves on the surface of the stator body can be obtained by rotation of the disks or rings. The grooves may be formed on the internal or external surfaces of the rings.

The stator that is manufactured by this process and incorporated into a vacuum pump has a body with at least one groove on the at least one stator surface. This at least one groove is defined by configuration of the plurality of stacked rings. The at least one groove extends in a substantially axial direction with respect to a body of the stator.

The main advantages of the invention are follows.

First, forming discs with different notches is simpler and cheaper than programming a milling machine every time when different settings are requested.

Second, by stacking discs with notches having different characteristics, it is possible to readily obtain stators having channels with variable sizes or with variable helix pitches.

Advantageously, the stators so obtained are easier to be mounted than the conventional stators.

Moreover, in case a stator portion is damaged, it is possible to replace only the discs corresponding to the damaged portion and to leave in place the undamaged discs, instead of replacing the whole stator.

Further features and advantages of the invention will become more apparent from the following description of some preferred embodiments, given only by way of non-limiting examples and shown in the accompanying drawings.

DETAILED DESCRIPTIONS OF THE DISCLOSURE

According to the invention, the process for manufacturing stators for vacuum pumps having a rotor co-operating with a surface of the stator for gas pumping, comprises a first step in which a plurality of stator discs or rings are formed, and a second step in which the stator discs or rings are coaxially stacked so as to form a stator surface in which there is defined at least one groove extending in substantially axial direction with respect to the stator body.

Advantageously, the stator discs or rings are obtained by sheet pressing (punching), thus making stator manufacturing simple and inexpensive. However, use of other mechanical working processes or of casting processes is possible.

Further in accordance with the invention, the discs or rings are provided with a plurality of notches, preferably during the pressing step. Due to this feature, when the discs or rings are stacked, it is possible to obtain stator surfaces having axially extending grooves, for instance helical grooves, depending on the angle by which said discs or rings are mutually rotated.

Figure 1A:
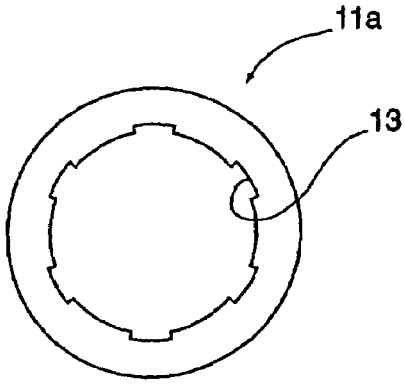
FIGS. 1A to 1C show different embodiments of stator rings.
Figure 1B:
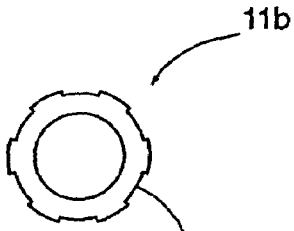
Figure 1C:
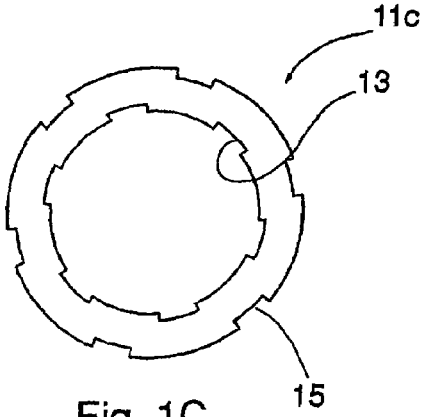

FIGS. 1A, 1B and 1C show three different embodiments of a stator ring obtained by sheet pressing according the present manufacturing process.

Figure 2A:
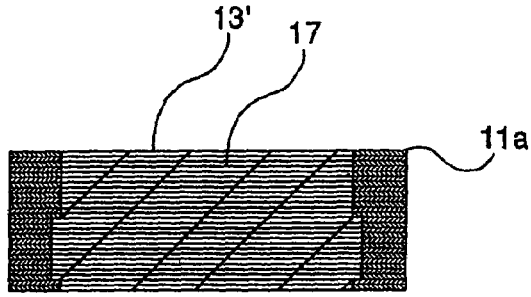
FIGS. 2A and 2B are a cross-sectional and a front view, respectively, of two embodiments of stators.
Figure 2B:
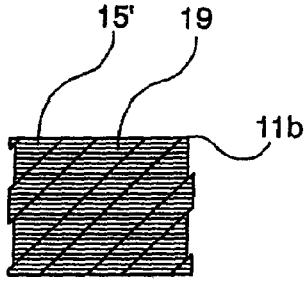

FIGS. 2*a* and 2B show the stator surface obtained by superimposing the corresponding rings.

More precisely, FIG. 2A shows the internal stator surface 17 obtained by superimposing stator rings 11*a* having notches 13 as shown in FIG. 1A and defining corresponding helical grooves 13'.

Similarly, FIG. 2B shows the external stator surface 19 obtained by superimposing stator rings 11*b* having notches 15 as shown in FIG. 1B and defining corresponding helical grooves 15'. The internal and external stator surfaces obtained by superimposing stator rings 11*c* having both internal notches 13 and external notches 15 as shown in FIG. 1C is equivalent to that shown in FIGS. 2A and 2B, respectively.

With reference to the embodiment shown in FIG. 1B, it is clear that stator ring 11*b* could be replaced by a stator disc if a cavity inside the stator is not required.

Advantageously, the profiles of internal and external notches 13 and 15 may have any shape, thereby allowing obtaining grooves with the desired cross-sectional shape, e.g. a rectangular, trapezoidal, concave and other shape.

In the illustrated embodiments the notches 13, 15 have the same shape and are uniformly distributed. Moreover, the discs forming the stator are identical, so as to further reduce production costs. Yet, always in accordance with the invention, use of different rings might be envisaged for obtaining non-cylindrical stators, e.g. frusto-conical stators, and/or grooves with non-uniform widths or depths, e.g. with a taper generally from the suction to the discharge pump side.

Advantageously, the disclosed process is particularly suitable for producing grooved stators for the manufacture of vacuum pumps including Holweck pumping stages.

In a Holweck stage, the direction of the groove helix is an essential parameter for the correct operation of the Holweck pumping stage, since the groves must spiralling upward from left to right or spiralling upward from right to left depending on the clockwise or counterclockwise direction or rotation of the rotor. Thus, it is clear that, by using the process of the invention, forming helical channels with clockwise or counterclockwise winding direction of the helix is particularly simple, since, when stacking the discs, it is enough to angularly offset said discs in either direction depending on the requirements.

Figure 3C:
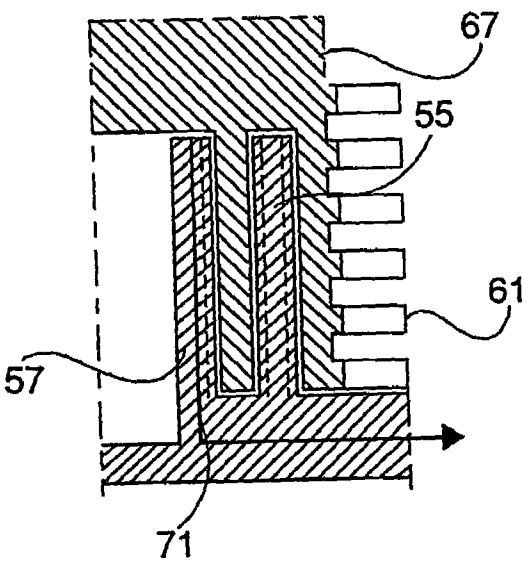
FIGS. 3A to 3C are partial cross-sectional views of three embodiments of vacuum pumps with the stators of the present invention.
Figure 3B:
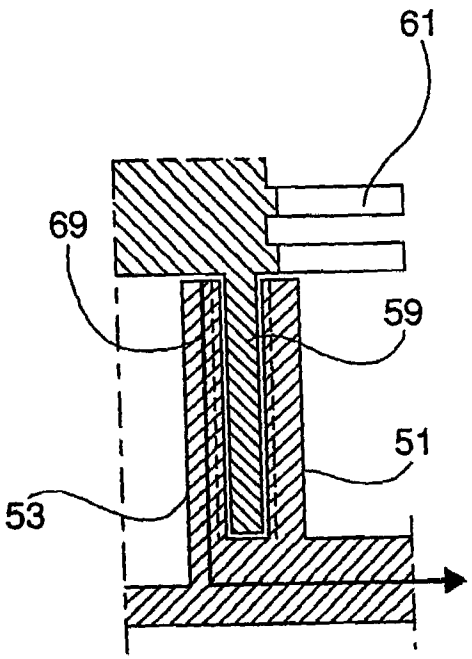
Figure 3A:
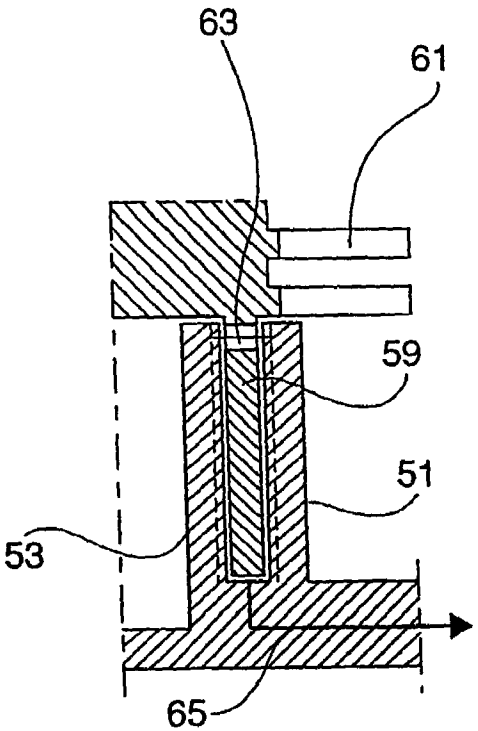

Turning now to FIGS. 3A to 3C, there are shown three examples of vacuum pumps obtained by using the stators of the invention.

More precisely, FIGS. 3A and 3B show a vacuum pump including a pair of cylindrical stators 51, 53 obtained by superimposing stator rings 11*a* as shown in FIG. 1A and rings 11*b* as shown in FIG. 1B, respectively. Pump rotor 59 rotates between cylindrical stators 51 and 53 and it is further equipped with rotor discs 61, upstream stators 51 and 53 with reference to the advancing direction of the pumped gas.

FIG. 3C shows a vacuum pump including a pair of stators 55, 57 obtained by superimposing stator rings 11*c* as shown in FIG. 1C and rings 11*b* as shown in FIG. 1B, respectively. Pump rotor 67 rotates between said cylindrical stators 55 and 57 and it is further equipped with rotor discs 61, upstream stators 55 and 57 with reference to the advancing direction of the pumped gas.

Referring to the configuration shown in FIG. 3A, rotor 61 has at least one radial opening 63 through which gas coming from previous stages passes, so as to exploit in parallel the pumping effect due to the co-operation between rotor 61 and the internal and the external grooved surface of stators 51 and 53, respectively. A channel 65 is provided downstream stators 51 and 53, with reference to the gas advancing direction, to evacuate the pumped gas in the direction denoted by the arrow.

On the contrary, in the configuration shown in FIG. 3B, rotor 61 has no radial holes and the pumping effect due to the co-operation between rotor 61 and the internal and the external grooved surface of stators 51 and 53, respectively, is exploited in series. A channel 69 is provided downstream stator 53, with reference to the gas advancing direction, to evacuate the pumped gas in the direction denoted by the arrow.

Turning again to the configuration shown in FIG. 3C, rotor 67 extends both between stators 55, 57, similarly to the configurations shown in FIGS. 3A and 3B, and outside stator 55.

Advantageously, stator 55 is of a kind obtained by superimposing stator discs 11*c* having both internal and external notches, and therefore it has axially extending grooves, preferably helical grooves, on both the internal and the external stator surfaces.

According to that configuration, the pumping effect due to the co-operation of rotor 67 with the internal and external grooved surfaces of stator 55 and the external grooved surface of stator 57 is exploited in series. A channel 71 is provided downstream stator 57 with reference to the gas advancing direction, to evacuate the pumped gas in the direction denoted by the arrow.

Figure 4:
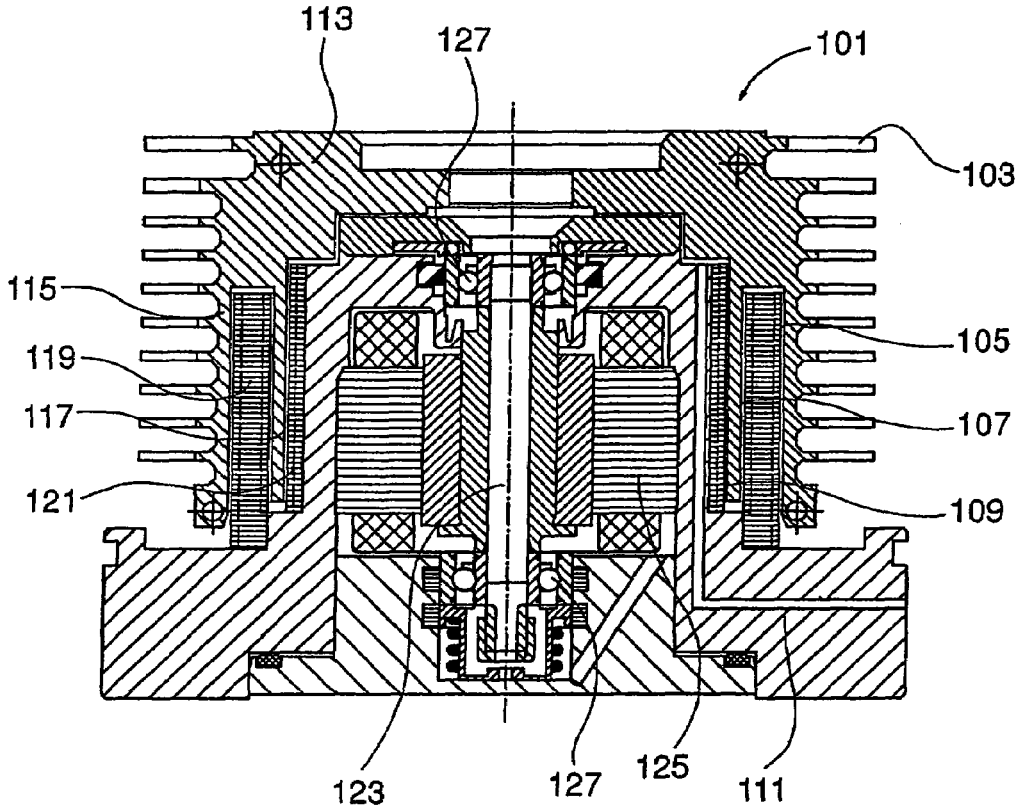
FIG. 4 is an axial cross-sectional view of a vacuum pump according to the embodiment shown in FIG. 3C.

Referring now to FIG. 4, there is shown a vacuum pump 101 made according to the design shown in FIG. 3C.

Pump 101 includes a plurality of turbomolecular pumping stages, resulting from the co-operation between rotor discs 103 and respective stator rings (not shown), and a plurality of so-called Holweck stages 105, 107, 109 connected in series and obtained by means of stators made by the process according to the invention.

Gas entering pump 101 passes through the turbomolecular stages in downward direction with reference to the drawing, and sequentially passes through Holweck stages 105, 107, 109, and it is then evacuated through a channel 111 formed in the pump base.

More particularly, with reference to the gas path in the Holweck stages, gas passes through stage 105 in upward direction, through stage 107 in downward direction and through stage 109 again in upward direction, until it reaches the inlet of evacuation channel 111, through which gas is evacuated to the outside or to a secondary pump.

Still referring to FIG. 4, rotor 113 of pump 101 is worked so as to define internally a pair of parallel cylindrical extensions 115 and 117 co-operating with stators 119 and 121 for gas pumping.

Said rotor 113 is rotated by a rotating shaft 123 mounted on bearings 127, pump motor 125 surrounding said shaft.

Figure 5:
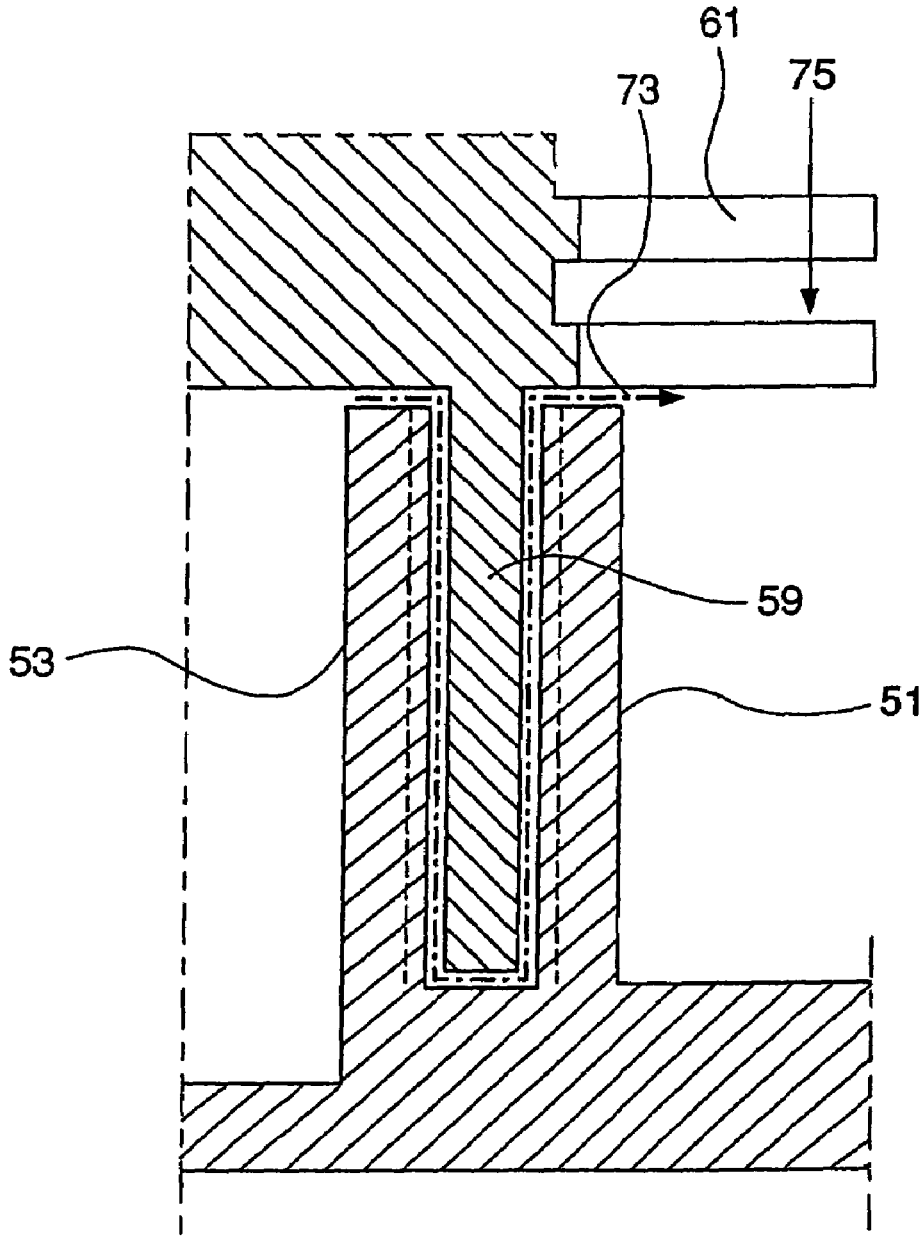
FIG. 5 is a partial cross-sectional view of a yet another embodiment of vacuum pump incorporating the stators of the present invention.

Turning now to FIG. 5, there is schematically shown another example of vacuum pump obtained by means of the stators of the invention. The configuration shown is substantially similar to that shown in FIG. 3B, and it differs therefrom only in respect of the winding direction of the helical grooves formed on the internal and the external surface of stators 51 and 53, respectively. By reversing the winding direction of said grooves, the pumping direction of the pumping stages defined by stators 51 and 53 and by rotor 59 included therebetween is reversed. Consequently, said pumping stages will pump gas possibly present in the region of rotating shaft 123 and of bearings 127 thereof, evacuating said gas through the discharge opening, as shown by arrow 73, i.e. in counter-current with respect to the main pumping direction shown by arrow 75. Such a configuration proves particularly advantageous when corrosive gases are pumped, since it prevents corrosive agents from accumulating in the region of the rotating shaft bearings and from consequently damaging said bearings.

According to the present invention the stators or described configuration can be manufactured in particularly simple manner. Indeed, in order to reverse the winding direction of the helical grooves of stators 51 and 53, it is sufficient to change the direction in which the pressed and stacked discs forming said stators are offset.

It will be understood that the various aspects or details of the present invention may be changed without departing from the scope of the invention. Furthermore, the foregoing description is for the purpose of illustration only, and not for the purpose of limitation.

What is claimed is:

1. A process for manufacturing stators of vacuum pump, comprising the steps of:

forming a plurality of discs or rings (11*a*; 11*b*; 11*c*), each disc or ring (11*a*; 11*b*; 11*c*) of said plurality having at least one notch (13; 15); and coaxially superimposing and rotating said discs or rings (11*a*; 11*b*; 11*c*) relative to each other to form at least one stator surface (17; 19), and defining on said stator surface (17; 19) at least one helical groove (13'; 15') corresponding to said notches (13; 15) for pumping gas extending in a substantially axial direction with respect to a stator body.

2. The process of claim 1, wherein said discs or rings (11*a*; 11*b*; 11*c*) have a plurality of notches (13; 15) defining a plurality of helical grooves extending in substantially axial direction with respect to the stator body when said discs or rings are superimposed.

3. The process as claimed in claim 1, wherein said rings have at least a pair of notches, one on an internal and the other on an external circumference thereof to define on the internal and the external surface of the stator body a respective groove extending in substantially axial direction with respect to the stator body when said rings are superimposed.

4. The process of claim 1, wherein said step of forming a plurality of discs or rings is performed by punching.

5. A stator of a vacuum pump comprising:

a body, a plurality of coaxially superimposed and rotatable relative to each other discs or rings (11*a*; 11*b*; 11*c*) forming said body, each of said discs or rings (11*a*; 11*b*; 11*c*) comprising at least one notch (13; 15) and said body having at least one stator surface (17; 19) with at least one helical groove (13'; 15') being defined by said at least one notch (13; 15) for pumping gas extending in a substantially axial direction with respect to said body.

6. The stator of claim 5, wherein said discs or rings have a plurality of notches (13; 15) defining a plurality of helical grooves (13'; 15') extending in substantially axial direction with respect to the stator body when said discs or rings (11*a*; 11*b*; 11*c*) are superimposed.

7. The stator as claimed in claim 6, wherein said notches (13; 15) have a polygonal profile, preferably a rectangular or trapezoidal profile.

8. The stator as claimed in claim 6, wherein said notches (13; 15) have the same sizes.

9. The stator as claimed in claim 6, wherein said notches (13; 15) are uniformly distributed along the circumference of said discs or rings (11*a*; 11*b*; 11*c*).

10. The stator of claim 5, wherein said stator rings have at least one pair of notches (13; 15), one on the internal circumference and the other on the external circumference, so as to define, on the internal and the external stator surface, respectively, a corresponding groove (13'; 15') extending in substantially axial direction with respect to the stator body when said rings are superimposed.

11. The stator of claim 5, wherein said stator body has a cylindrical shape.

12. The stator of claim 5, wherein said stator body has a frusto-conical shape.

13. The stator as claimed in claim 5, wherein said at least one groove (13; 15) defines a Holweck pumping stage with a corresponding rotor of the vacuum pump.

14. A vacuum pump comprises:

a stator having a body formed by a plurality of coaxially superimposed and rotatable relative to each other discs or rings (11*a*; 11*b*; 11*c*), each disc or ring of said plurality comprising at least one notch (13; 15), and said body having at least one stator surface (17; 19) with at least one helical groove (13'; 15') corresponding to said at least one notch (13; 15) for pumping gas extending in substantially axial direction with respect to said body.

15. The vacuum pump of claim 14, further comprising a turbomolecular pumping stage.

16. The vacuum pump as claimed in claim 15, wherein said turbomolecular pumping stage is located upstream said stator in a gas advancing direction.

* * * * *